US009682387B2

(12) United States Patent
Alexander et al.

(10) Patent No.: US 9,682,387 B2
(45) Date of Patent: Jun. 20, 2017

(54) NOZZLE

(71) Applicant: FNA IP Holdings, Inc., Pleasant Prairie, WI (US)

(72) Inventors: Gus Alexander, Inverness, IL (US); Paulo Rogerio Funk Kolicheski, Gurnee, IL (US)

(73) Assignee: FNA IP Holdings, Inc., Pleasant Prairie, WI (US)

( * ) Notice: Subject to any disclaimer, the term of this patent is extended or adjusted under 35 U.S.C. 154(b) by 0 days.

(21) Appl. No.: 14/943,370

(22) Filed: Nov. 17, 2015

(65) Prior Publication Data

US 2017/0136474 A1 May 18, 2017

(51) Int. Cl.

| | |
|---|---|
| ***B05B 3/02*** | (2006.01) |
| ***B05B 3/04*** | (2006.01) |
| ***B05B 1/34*** | (2006.01) |
| ***B05B 1/30*** | (2006.01) |

(52) U.S. Cl.

CPC ..... *B05B 1/3426* (2013.01); *B05B 1/3026* (2013.01)

(58) Field of Classification Search

CPC ..... B05B 1/06; B05B 1/3026; B05B 1/3426; B05B 3/008; B05B 3/026; B05B 3/027; B05B 3/028; B05B 3/0404; B05B 3/0409; B05B 3/0463; B05B 3/0636

See application file for complete search history.

(56) References Cited

U.S. PATENT DOCUMENTS

| | | | | |
|---|---|---|---|---|
| 5,217,166 | A * | 6/1993 | Schulze | B05B 3/0463 239/227 |
| 5,328,097 | A * | 7/1994 | Wesch | B05B 3/0463 239/243 |
| 5,395,053 | A * | 3/1995 | Frech | B05B 3/0463 239/227 |
| 5,551,635 | A * | 9/1996 | Jager | B05B 3/0463 239/240 |
| 8,820,659 | B2 | 9/2014 | Wesch et al. | |
| 2001/0019083 | A1* | 9/2001 | Marks | B05B 3/0463 239/225.1 |
| 2003/0098366 | A1* | 5/2003 | Blessing | B05B 3/0463 239/225.1 |
| 2005/0164554 | A1* | 7/2005 | Cattaneo | B05B 3/0463 439/595 |
| 2008/0265058 | A1* | 10/2008 | Wimmer | B05B 3/0463 239/258 |

* cited by examiner

*Primary Examiner* — Darren W Gorman
(74) *Attorney, Agent, or Firm* — Steven E. Jedlinski; Jeffrey T. Placker; Holland & Knight LLP

(57) ABSTRACT

In an embodiment, a rotating nozzle including a generally cylindrical interior having an inlet at a circumferential wall adjacent a first end of the body portion and a generally axial exit adjacent a second end of the body portion. A nozzle portion is at least partially received within, and rotatable relative to, the cylindrical interior. The nozzle portion includes an at least partially conical shape, having a relatively smaller cross section adjacent the first end of the body portion. The nozzle portion defines a generally longitudinal flow passage having an inlet opening extending between an exterior of the nozzle portion and the flow passage adjacent the first end of the body portion and a generally axially oriented exit adjacent the second end of the body portion. The rotating nozzle further includes end cap disposed at least partially enclosing the cylindrical interior adjacent the first end of the body portion.

18 Claims, 7 Drawing Sheets

NOZZLE

TECHNICAL FIELD

The present disclosure generally relates to nozzles, and more particularly relates to rotating nozzles.

BACKGROUND

Spray nozzles are utilized in many areas where a spray of fluid is required, for example, tank and drum washing, concrete and asphalt washing or spraying, vehicle washing, and dish washing, etc. For many applications, a rotating spray nozzle may provide advantageous effects. For example, the rotation of a spray stream may distribute the spray over a specific area to be cleaned or sprayed. Distributing the spray over a specific region may improve washing or cleaning efficiency, e.g., by allowing a greater area to be sprayed with less movement of the spraying unit.

SUMMARY OF THE DISCLOSURE

According to an implementation, a rotating nozzle may include a body portion defining a generally cylindrical interior having an inlet at a circumferential wall of the cylindrical interior and adjacent a first end of the body portion. The body portion may also include an exit generally axially oriented relative to the cylindrical interior and adjacent a second end of the body portion. The rotating nozzle may also include a nozzle portion at least partially received within the cylindrical interior and rotatable relative to the cylindrical interior. The nozzle portion may have an at least partially conical shape, having a relatively smaller cross section adjacent the first end of the body portion. The nozzle portion may define a generally longitudinal flow passage having an inlet opening extending between an exterior of the nozzle portion and the flow passage adjacent the first end of the body portion and a generally axially oriented exit adjacent the second end of the body portion. The rotating nozzle may further include an end cap disposed at least partially enclosing the cylindrical interior adjacent the first end of the body portion.

One or more of the following features may be included. The generally cylindrical interior may include a plurality of inlets. The plurality of inlets may be angled relative to a radius of the generally cylindrical interior. The plurality of inlets may be oriented to provide an inlet flow of water entering the generally cylindrical interior generally tangentially to the generally cylindrical interior.

The generally cylindrical interior may include a generally concave shape adjacent the second end of the body portion. The exit of the generally cylindrical interior may have a diameter that is less than a diameter of the generally cylindrical interior.

The nozzle portion includes a generally convex shape adjacent the second end of the body portion. The generally convex shape of the nozzle portion may be generally complimentary with the generally concave shape of the cylindrical interior of the body portion. The nozzle portion may include a plurality of inlet openings. The plurality of inlet openings of the nozzle portion may include a plurality of vanes. The plurality of inlet openings of the nozzle portion may be oriented at an angle relative to a radius of the nozzle portion.

The conical shape of the nozzle portion may include a tapered sidewall portion. The tapered sidewall may be disposed for movement along the generally cylindrical interior of the body portion.

The rotating nozzle may further include a generally spherical member disposed between at least a portion of an interior surface of the end cap and at least a portion of the nozzle portion adjacent the first end of the body portion. The generally spherical member may be at least partially received within a recess in the nozzle portion adjacent the first end of the body portion. The generally spherical member may be at least partially received in a circumferential groove defined by the portion of the interior surface of the end cap.

According to another implementation, a rotating nozzle may include a body portion defining a generally cylindrical interior having a plurality of inlet openings disposed adjacent a first end of the cylindrical interior. The body portion may define a generally concave shape adjacent a second end of the cylindrical interior. A nozzle portion may have a generally conical shape with a relatively smaller diameter adjacent the first end of the cylindrical interior and a relatively larger diameter adjacent the second end of the cylindrical interior. The nozzle portion may have a generally convex shape adjacent the second end of the cylindrical interior that is generally complimentary with the generally concave shape of the cylindrical interior. The nozzle portion may define a generally longitudinal flow passage extending between a plurality of inlets adjacent the first end of the cylindrical interior and a generally centrally located exit adjacent the second end of the cylindrical interior. The rotating nozzle may also include an end cap configured to at least partially enclose the first end of the cylindrical interior, and defining a generally circumferential groove. The rotating nozzle may also include a generally spherical member disposed between the nozzle portion and the end cap. The generally spherical member may be at least partially disposed in the generally circumferential groove. The generally spherical member may maintain cooperation between nozzle portion and the body portion within the cylindrical interior.

One or more of the following features may be included. The plurality of inlet openings of the body portion may be arranged to direct an inlet flow generally tangentially relative to the generally cylindrical interior. The plurality of inlets of the nozzle portion may be oriented at an angle relative to a radius of the nozzle portion.

According to another implementation, a rotating nozzle may include a body portion defining a generally cylindrical interior having three inlet openings adjacent a first end of the cylindrical interior. Each of the inlet openings may be arranged to direct an inlet flow generally tangentially relative to the cylindrical interior. The body portion may further define a generally concave shape adjacent to a second end of the body portion. The concave shape may include a generally axial opening. The rotating nozzle may also include a nozzle portion including a generally conical body having a relatively narrow portion adjacent the first end of the cylindrical interior and a relatively wide portion adjacent the second end of the cylindrical interior. The relatively wide end may have a generally convex shape that is generally complimentary with the generally concave shape of the cylindrical interior. The nozzle portion may have a longitudinal flow pass extending between four inlets adjacent the first end of the cylindrical interior and a generally axial exit adjacent the second end of the cylindrical interior. Tach of the four inlets may be oriented at an angle relative to a radius of the nozzle portion. The rotating nozzle may also include an end cap at least partially enclosing the first end of the cylindrical interior. The end cap may have a generally circumferential groove facing the cylindrical interior. The rotating nozzle may further include a generally spherical member at least partially disposed within the circumferential groove and abutting at least a portion of the nozzle portion. The spherical member may be configured for maintaining contact between the convex shape of the nozzle portion and the concave shape of the cylindrical interior.

One or more of the following features may be included. The generally conical body of the nozzle portion may have an angle of about 10 degrees.

The details of one or more implementations are set forth in the accompanying drawings and the description below. Other features and advantages will become apparent from the description, the drawings, and the claims.

DETAILED DESCRIPTION OF EXAMPLE EMBODIMENTS

Figure 1:
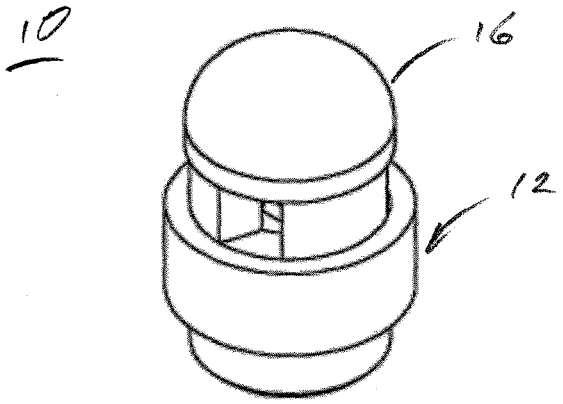
FIG. 1 is a perspective view of a rotating nozzle assembly according to an example embodiment.
Figure 2:
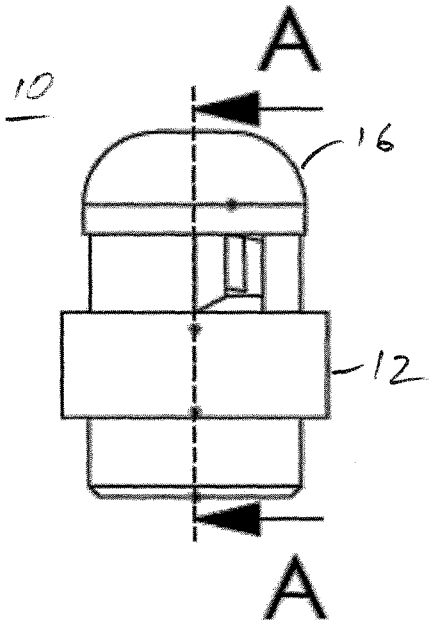
FIG. 2 is a first side elevation view of the rotating nozzle assembly of FIG. 1.

According to an embodiment, the present disclosure may generally relate to a rotating nozzle. In general, the rotating nozzle may provide an emitted fluid stream that may generally rotate in a conical pattern. For example, the emitted fluid stream may be oriented at an angle relative to an axis of the nozzle, and the emitted fluid stream may generally rotate about the axis of the nozzle to effectuate a generally conical shape. In some implementations, a rotating nozzle according to the present disclosure may be utilized in connection with a power washer, or other spaying apparatus. However, it will be appreciated that a nozzle consistent with the present disclosure may be utilized for a variety of different applications.

Referring to FIGS. 1 through 5, there is shown an example embodiment of a rotating nozzle 10 consistent with the present disclosure. In general, rotating nozzle 10 may generally include body portion 12, nozzle portion 14, and end cap 16. In general, d as will be described in greater detail below, nozzle portion 14 may be disposed at least partially within body portion 12, which may be at least partially enclosed by end cap 16. Water (or some other fluid that may be utilized in connection with rotating nozzle 10) may generally enter body portion 12 through one or more inlets. In some embodiments, the water may enter the generally cylindrical interior of body portion 12 in a swirling manner. The water may interact with nozzle portion 14 resulting in the rotation of nozzle portion 14 within the cylindrical interior of body portion 12. Nozzle portion 14 may have a generally conical shape with a generally longitudinal, or axial, fluid path. As such, when nozzle portion 14 rotates within body portion 12, the longitudinal fluid path of nozzle portion 14 may be oriented at an angle relative to a central axis of body portion 12. The angular orientation of the fluid path of nozzle portion 14 may give rise to the rotating conical water stream emitted by the rotating nozzle. Particular features of various example embodiments of rotating nozzles consistent with the present disclosure will be described in greater detail herein. It will be appreciated that while water is utilized as an example fluid that may be conveyed by the rotating nozzle, this is only intended as an illustrative example, as any other fluid susceptible to being conveyed through a nozzle may similarly be utilized.

As generally described above, and with further reference to FIGS. 6 through 9, body portion 12 may define generally cylindrical interior 20. Generally cylindrical interior 20 may include an inlet (e.g., inlet 22) adjacent a first end of body portion 12. In some embodiments, body portion 12 may include a plurality of inlets 22 into generally cylindrical interior 20. For example, in the illustrated embodiment, body portion 12 may include three inlets 22 into generally cylindrical opening to the first end of body portion 12. As generally shown, inlets 22 may be generally radially spaced around cylindrical interior 20. While the example rotating nozzle is shown including three inlets into the generally cylindrical interior of the body portion, it will be appreciated that a greater or fewer number of inlets may be utilized, including a single inlet.

As shown in the illustrated example embodiment, in some embodiments, inlet 22 may be angled relative to a radius of generally cylindrical interior 20. For example, in the illustrated embodiment including three inlets 22, the inlets may be oriented to provide an inlet flow of water entering cylindrical interior that is generally tangential to cylindrical interior 20. As such, the inlets may provide a generally swirling flow of water entering cylindrical interior 20.

Figure 9:
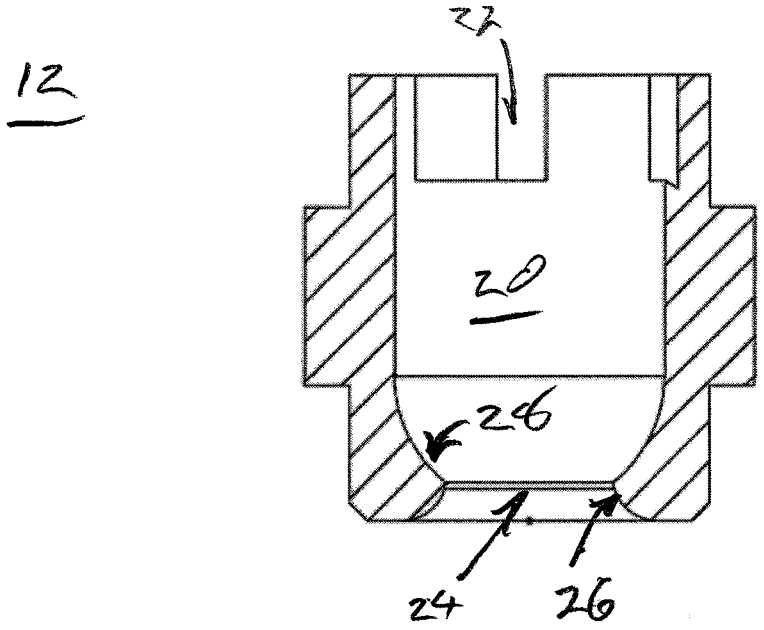
FIG. 9 is a cross-sectional view of the body portion along section line A-A of FIG. 8.

With particular reference to FIG. 9, body portion 12 may further include exit 24, which may be generally axially oriented relative to cylindrical interior 20, and may be generally adjacent to a second end of body portion 12. Exit 24 may have a diameter that is less than a diameter of generally cylindrical interior 20. In some implementations, exit 24 may include flared region 26 downstream from exit 24. In general, flared region 26 may have a diameter that may be larger than a diameter of exit 24.

As shown, in some embodiments, cylindrical interior 20 may include a generally concave shape (e.g., including concave wall 28) adjacent the second end of body portion 12. As shown, e.g., in FIGS. 3 and 5, nozzle portion 14 may engage concave wall 28, e.g., may rotating and/or pivot, at least in part, against concave wall 28. In an example, concave wall 28 may include a low wear material. In some embodiments, the low wear material may include a material having a low coefficient of friction. Further, in some embodiments, concave wall 28 may include a smooth and/or polished surface. Further, in some embodiments, concave wall 28 may include a hardwearing material (e.g., a wear resistant material). In some embodiments, concave wall 28 may be formed from a different material (e.g., a low wear material) than the remainder of body portion 12. In some embodiments, the entirety of body portion 12 may be formed from a low wear material. Other implementations may be equally utilized.

As shown, e.g., in FIGS. 1 through 5, rotating nozzle 10 may include nozzle portion 14 that may be at least partially received within generally cylindrical interior 20. Further, nozzle portion 14 may be rotatable and/or pivotable relative to cylindrical interior 20. Referring also to FIGS. 10 through 13, nozzle portion 14 may have an at least partially conical shape. As generally shown, nozzle portion 14 may be at least partially received within cylindrical interior 20 with the relatively smaller cross-section portion of the at least partially conical shape disposed adjacent the first end of body portion 12. The conical shape of nozzle portion 14 may include tapered sidewall 30. As shown, e.g., in FIGS. 3 and 5, in some embodiments, tapered sidewall 30 may be disposed in contact with body portion 12 defining cylindrical interior 20. Tapered sidewall 30 may be disposed for movement along generally cylindrical interior 20 of body portion 12. As such, nozzle portion 14 may be oriented with the longitudinal axis thereof at an angle relative to the longitudinal axis of body portion 12. For example, the angle between the longitudinal axis of nozzle portion 14 and the longitudinal axis of body portion 12 may be generally equal to the angle of tapered sidewall 30 relative to the longitudinal axis of nozzle portion 14. In an example embodiment, tapered sidewall 30 may have an angle of about 10 degrees relative to the longitudinal axis of nozzle portion 14. However, it will be appreciated that greater or smaller taper angles may be utilized. As will be appreciated consistent with the description below, the taper angle of tapered sidewall 30 may influence the angular spread of the conical spray pattern provided by rotating nozzle 10.

Figure 13:
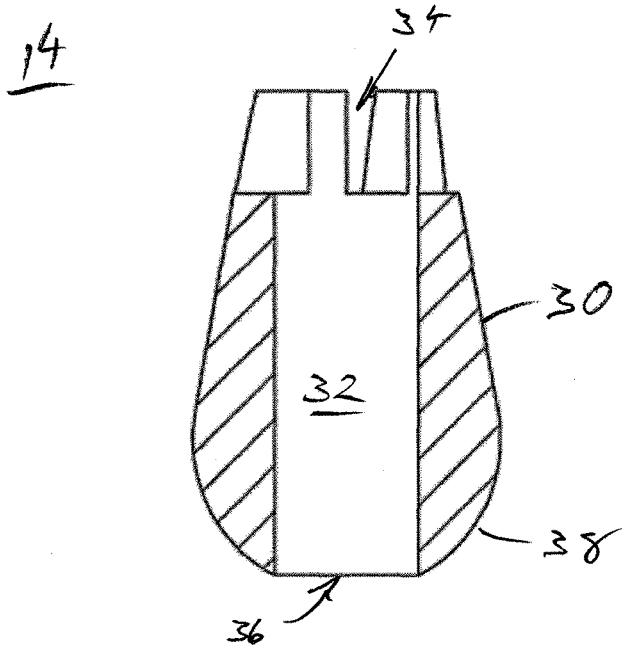
FIG. 13 is cross-sectional view of the nozzle portion along section line A-A of FIG. 12.
Figure 14:
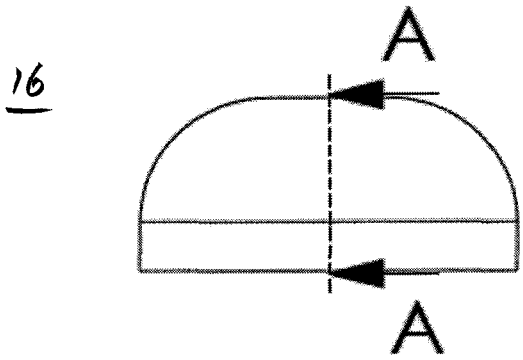
FIG. 14 is a side view of a cap portion of the rotating nozzle assembly of FIG. 1.

Nozzle portion 14 may define a generally longitudinal flow passage (e.g., longitudinal flow passage 32 shown in FIG. 13). Longitudinal flow passage 32 may have an inlet opening (e.g. inlet openings 34) extending between an exterior of nozzle portion 14 and longitudinal flow passage 32 adjacent the first end of body portion 12 (e.g., adjacent inlets 22) and a generally axially oriented exit (e.g., exit 36) adjacent the second end of body portion 12 (e.g., adjacent exit 24). As shown, e.g., in FIGS. 10 and 11, in some embodiments nozzle portion 14 may include a plurality of inlet openings 34. For example, in the illustrated example, nozzle portion 14 may include four inlet openings 34. However, it will be appreciated that a greater or fewer (e.g., including only one inlet opening) may be utilized in different implementations. In general, water (or another fluid) entering cylindrical interior 20 via inlets 22 may be directed generally tangentially relative to cylindrical interior 20, in a manner described above. The water entering cylindrical interior 20 may interact with nozzle portion 14 (e.g., via inlet openings 34) and may impart a rotational force on nozzle portion 14. After contacting inlet openings 34 and inducing rotation of nozzle portion 14, the water may generally be directed through longitudinal flow passage 32 and may exit nozzle portion 14 via exit 36, e.g., which may be generally aligned with exit 24 of body portion 12.

Figure 10:
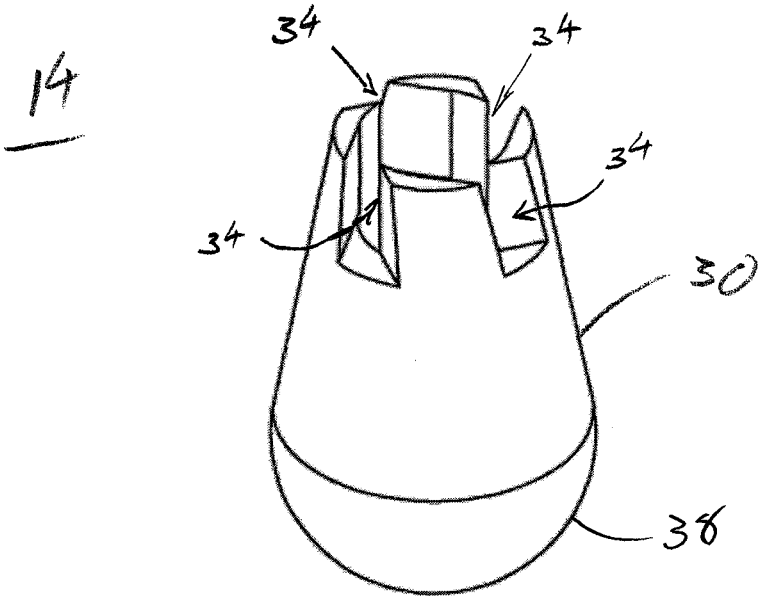
FIG. 10 is a perspective view of a nozzle portion of the rotating nozzle assembly of FIG. 1.
Figure 11:
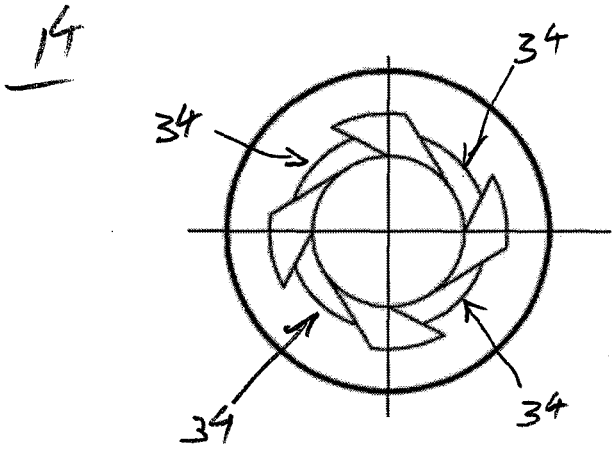
FIG. 11 is a top plan view of the nozzle portion of FIG. 10.
Figure 12:
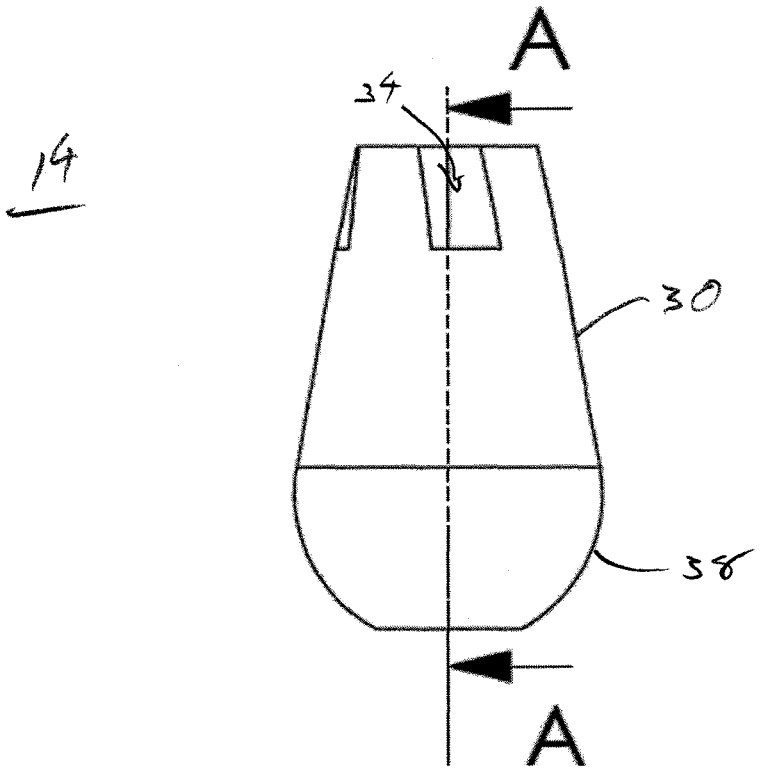
FIG. 12 is a side-elevation view of the nozzle portion of FIG. 10.

In some embodiments, e.g., as depicted in FIG. 10, inlet openings 34 may be generally configured as a plurality of vanes, e.g., which may generally extend upwardly from nozzle portion 14 (e.g., relative to the longitudinal axis of nozzle portion 14). In some such configurations, inlet openings 34 may be oriented at an angle relative to a radius of nozzle portion 14. For example, the angle of inlet openings relative to the radius of nozzle portion 14 may influence the speed of rotation of nozzle portion 14. For example, different angles of inlet openings 34 may result in different interactions between nozzle portion 14 and the tangential flow of water entering cylindrical interior 20 via inlets 22. The different interactions between nozzle portion 14 and the tangential flow of water resulting from different angles of inlet openings 34 may be similar to the interactions between a fluid stream and an impeller or fan having differently angled vanes. In some embodiments, as shown in the illustrated example, the angle of the inlet openings 34 may be generally opposite to the direction of tangential flow of the incoming water, e.g. which may result in a slower resultant speed of rotation of nozzle portion 14. It will be appreciated that the magnitude and direction of the angle of inlet openings 34 may be selected to provide a desired rotational speed of nozzle portion 14, which may also be influenced the angle of inlets 22 of body portion 12, as well as the flow rate and/or pressure of the water entering cylindrical interior 20.

Figure 3:
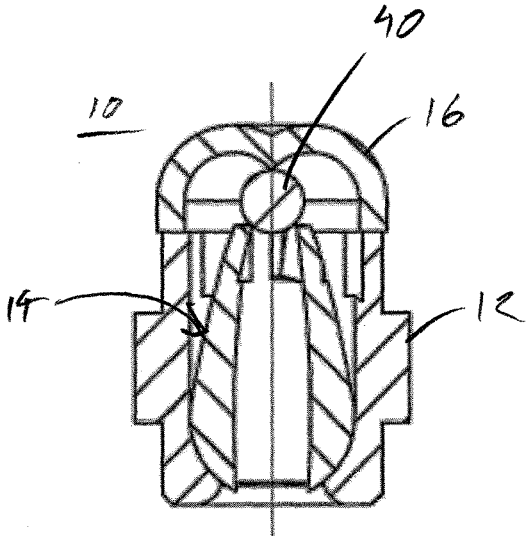
FIG. 3 is a cross-sectional view of the rotating nozzle assembly along section line A-A of FIG. 2.
Figure 4:
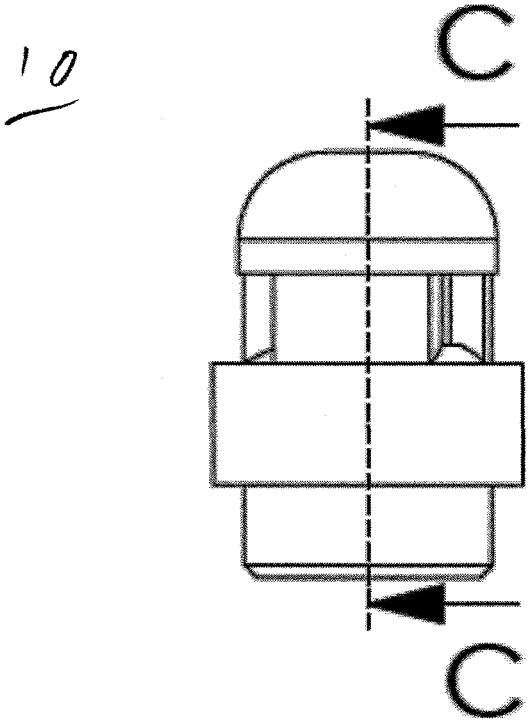
FIG. 4 is a second side elevation view of the rotating nozzle assembly of FIG. 1.
Figure 5:
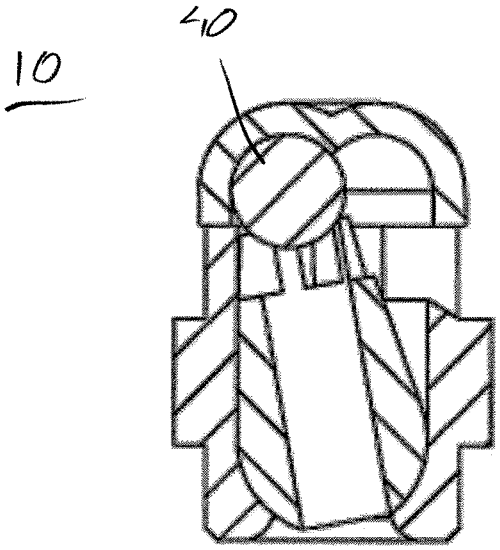
FIG. 5 is a cross-sectional view of the rotating nozzle assembly along section line C-C of FIG. 4.
Figure 6:
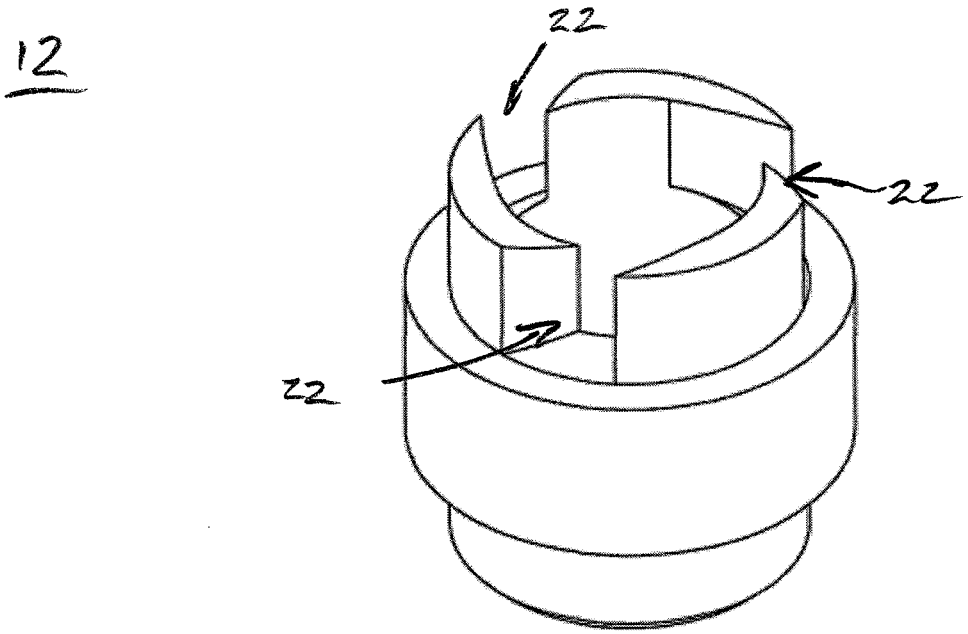
FIG. 6 is a perspective view of a body portion of the rotating nozzle assembly of FIG. 1.
Figure 7:
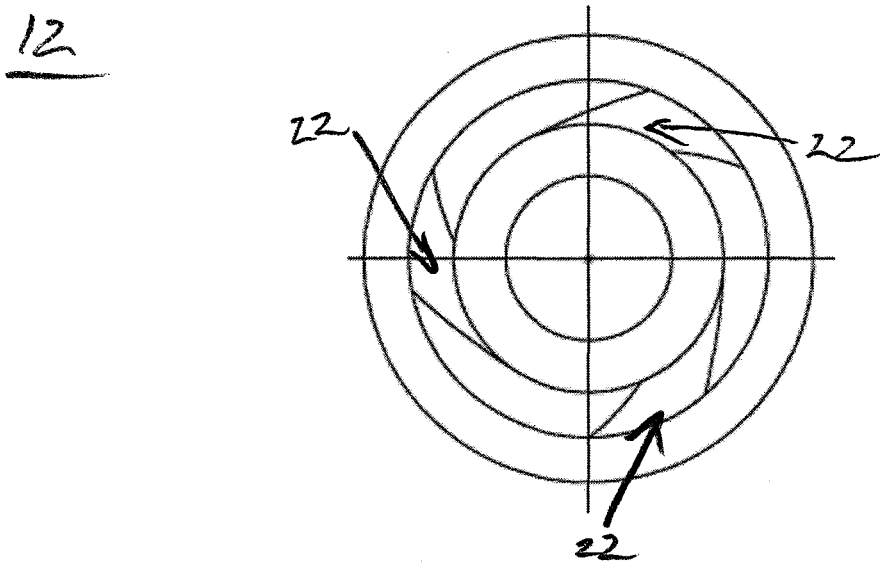
FIG. 7 is a top plan view of the body portion of FIG. 6.
Figure 8:
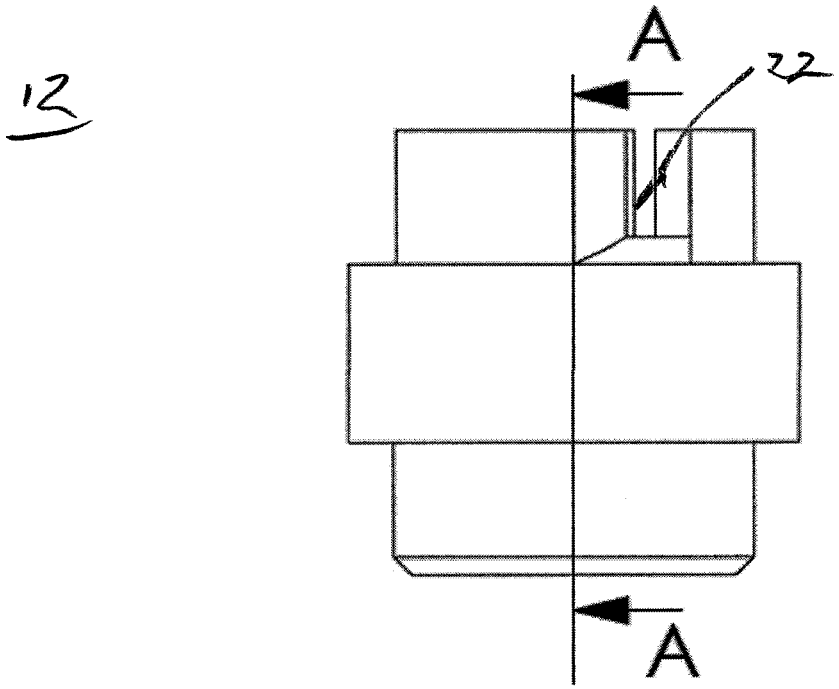
FIG. 8 is a side elevation view of the body portion of FIG. 6.

As generally discussed above, and as depicted, e.g., in FIGS. 3 and 5, tapered sidewall 30 of nozzle portion 14 may be generally oriented parallel to the sidewall of cylindrical interior 20. As such, longitudinal flow passage 32 and exit 36 may be generally oriented at an angle relative to the longitudinal axis of body portion 12. As nozzle portion 14 rotates within cylindrical interior 20 (e.g. which may in some embodiments include nozzle portion 14 rolling along the sidewall of cylindrical interior 20), the stream of water emitted from exit 36 may also be at an angle relative to the longitudinal axis of body portion 12, and may generally rotate around the longitudinal axis of body portion 12. The rotational motion of nozzle portion 14 and the angular orientation of longitudinal flow passage 32 and exit 36 relative to the longitudinal axis of body portion 12 may produce a stream of emitted water rotating in a conical patter relative to the longitudinal axis of body portion 12.

Nozzle portion 14 may include a generally convex shape (e.g., convex region 38) adjacent the second end of body portion 12 (e.g., when nozzle portion 14 is at least partially received within cylindrical interior 20). Accordingly, in some embodiments, nozzle portion 14 may have a generally "teardrop" shape, having convex portion that may taper to a generally conical portion. In some embodiments, the shape of convex region 38 of nozzle portion 14 may be generally complimentary with the generally concave wall 28 of cylindrical interior 20 of body portion 12. As such, and as generally depicted, e.g., in FIGS. 3 and 5, convex region 38 of nozzle portion 14 may seat relative to concave sidewall 28 of body portion 12, e.g., and may be capable of rotating at an angle relative body portion 12. Further, in some embodiments, convex region 38 of nozzle portion 14 may seat relative to concave sidewall 28 of body portion 12 and may generally form a seal there between, e.g., which may prevent and/or reduce flow or leakage of water between nozzle portion 14 and body portion 12 via exit 24 (e.g., such that the majority of the water may flow through longitudinal flow passage 32 and may be emitted via exit 36). In a similar manner as discussed with respect to concave sidewall 28, convex region 38 may include a low wear material. For example, in some embodiments, the low wear material may include a material having a low coefficient of friction. Further, in some embodiments, convex region may include a smooth and/or polished surface. Further, in some embodiments, convex region 38 may include a hardwearing material (e.g., a wear resistant material). In some embodiments, convex region 38 may be formed from a different material (e.g., a low wear material) than the remainder of nozzle portion 14. In some embodiments, the entirety of nozzle portion 14 may be formed from a low wear material. Other implementations may be equally utilized.

Figure 15:
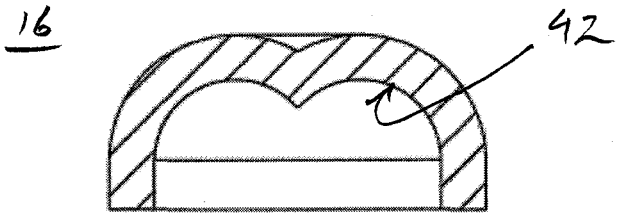
FIG. 15 is a cross-sectional view of the cap portion of FIG. 14.

As generally discussed above, rotating nozzle 10 may further include end cap 16. End cap 16 may be disposed at least partially enclosing cylindrical interior 20 adjacent the first end of body portion 12. Additionally, and as depicted in FIGS. 3 and 5, in some embodiments rotating nozzle 10 may further include generally spherical member 40 disposed between at least a portion of an interior surface of end cap 16 and at least a portion of nozzle portion 14 adjacent the first end of body portion 12. Generally spherical member 40 may include, for example, a ball bearing or similar feature. Further, generally spherical member 40 may, in some implementations, include a low wear material, as generally discussed above. However, in other embodiments, generally spherical member 40 may include a material other than a low wear material. In an embodiment, generally spherical member 40 may be at least partially received within a recess in nozzle portion 14 adjacent the first end of body portion 14. For example, the end of longitudinal flow passage 32 may provide a recess (e.g., extending below a nominal end of nozzle portion 14) that may receive at least a portion of generally spherical member 40. In some embodiments, nozzle portion 14 may include a concave region or a recess adjacent the first end of body portion 12 that may be specifically configured to receive at least a portion of generally spherical member 40. Further, generally spherical member 40 may be at least partially received in circumferential groove 42 defined by a portion of the interior surface of end cap 16 (e.g., as generally depicted in FIGS. 3, 5, and 15).

As generally spherical member 40 may be at least partially received within a recess in nozzle portion 14 and may be at least partially received in circumferential groove 42, generally spherical member 40 may, at least in part, control the motion of nozzle portion 14, e.g., by guiding rotation of nozzle portion 14 in a circular path and maintaining the angular orientation of nozzle portion 14 relative to the longitudinal axis of body portion 12. For example, generally spherical member 40 and circumferential groove 42 may maintain tapered sidewall 30 generally aligned with the sidewall of cylindrical interior 20. As such, generally spherical member 40 and circumferential groove 42 may aid in maintaining the rotating conical pattern of the water stream emitted via exit 36 of nozzle portion 14. Further, in some embodiments, generally spherical member 40 may aid in maintaining a relative position between convex region 38 of nozzle portion 14 and concave sidewall 28 of body portion 12. For example, generally spherical member 40 may aid in maintaining nozzle portion 14 in a seated position within body portion 12, e.g., which may assist in achieving a desired level of engagement and sealing between nozzle portion 14 and body portion 12.

A variety of features of example implementations of a rotating nozzle have been described. However, it will be appreciated that various additional features and structures may be implemented in connection with a pump according to the present disclosure. As such, the features and attributes described herein should be construed as a limitation on the present disclosure.

What is claimed is:

1. A rotating nozzle comprising:

a body portion defining a generally cylindrical interior having an inlet at a circumferential wall of the cylindrical interior and adjacent a first end of the body portion, and an exit generally axially oriented relative to the cylindrical interior and adjacent a second end of the body portion;

a nozzle portion at least partially received within the cylindrical interior and rotatable relative to the cylindrical interior, the nozzle portion having an at least partially conical shape, having a relatively smaller cross section adjacent the first end of the body portion, the nozzle portion defining a generally longitudinal flow passage having an inlet opening extending between an exterior of the nozzle portion and the flow passage adjacent the first end of the body portion and a generally axially oriented exit adjacent the second end of the body portion, wherein the inlet opening of the nozzle portion is oriented at an angle relative to a radius of the nozzle portion; and an end cap disposed at least partially enclosing the cylindrical interior adjacent the first end of the body portion.

2. The rotating nozzle of claim 1, wherein the generally cylindrical interior comprises a plurality of inlets.

3. The rotating nozzle of claim 2, wherein the plurality of inlets are angled relative to a radius of the generally cylindrical interior.

4. The rotating nozzle of claim 3, wherein the plurality of inlets are oriented to provide an inlet flow of water entering the generally cylindrical interior generally tangentially to the generally cylindrical interior.

5. The rotating nozzle of claim 1, wherein the generally cylindrical interior includes a generally concave shape adjacent the second end of the body portion.

6. The rotating nozzle of claim 1, wherein the exit of the generally cylindrical interior has a diameter that is less than a diameter of the generally cylindrical interior.

7. The rotating nozzle of claim 1, wherein the nozzle portion includes a generally convex shape adjacent the second end of the body portion.

8. The rotating nozzle of claim 7, wherein the generally cylindrical interior includes a generally concave shape adjacent the second end of the body portion; and wherein the generally convex shape of the nozzle portion is generally complimentary with the generally concave shape of the cylindrical interior of the body portion.

9. The rotating nozzle of claim 1, wherein the nozzle portion includes a plurality of inlet openings.

10. The rotating nozzle of claim 9, wherein the plurality of inlet openings of the nozzle portion include a plurality of vanes.

11. The rotating nozzle of claim 1, wherein the conical shape of the nozzle portion includes a tapered sidewall portion.

12. The rotating nozzle of claim 11, wherein the tapered sidewall is disposed for movement along the generally cylindrical interior of the body portion.

13. The rotating nozzle of claim 1, further including a generally spherical member disposed between at least a portion of an interior surface of the end cap and at least a portion of the nozzle portion adjacent the first end of the body portion.

14. The rotating nozzle of claim 13, wherein the generally spherical member is at least partially received within a recess in the nozzle portion adjacent the first end of the body portion.

15. The rotating nozzle of claim 13, wherein the generally spherical member is at least partially received in a circumferential groove defined by the portion of the interior surface of the end cap.

16. A rotating nozzle comprising:

a body portion defining a generally cylindrical interior having a plurality of inlets disposed adjacent a first end of the cylindrical interior and defining a generally concave shape adjacent a second end of the cylindrical interior, wherein the plurality of inlets of the body portion are arranged to direct an inlet flow generally tangentially relative to the generally cylindrical interior;

a nozzle portion having a generally conical shape with a relatively smaller diameter adjacent the first end of the cylindrical interior and a relatively larger diameter adjacent the second end of the cylindrical interior, the nozzle portion having a generally convex shape adjacent the second end of the cylindrical interior that is generally complimentary with the generally concave shape of the cylindrical interior, and defining a generally longitudinal flow passage having a plurality of inlet openings extending between an exterior of the nozzle portion adjacent the first end of the cylindrical interior of the body portion and a generally centrally located exit adjacent the second end of the cylindrical interior of the body portion, wherein the plurality of inlet openings of the nozzle portion are oriented at an angle relative to a radius of the nozzle portion;

an end cap configured to at least partially enclose the first end of the cylindrical interior, and defining a generally circumferential groove; and a generally spherical member disposed between the nozzle portion and the end cap, the generally spherical member at least partially disposed in the generally circumferential groove, the generally spherical member maintaining cooperation between nozzle portion and the body portion within the cylindrical interior.

17. A rotating nozzle comprising:

a body portion defining a generally cylindrical interior having three inlets adjacent a first end of the cylindrical interior, each of the inlets arranged to direct an inlet flow generally tangentially relative to the cylindrical interior, the body portion further defining a generally concave shape of the cylindrical interior adjacent to a second end of the body portion, the concave shape including a generally axial opening;

a nozzle portion including a generally conical body having a relatively narrow portion adjacent the first end of the cylindrical interior and a relatively wide portion adjacent the second end of the cylindrical interior, the relatively wide end having a generally convex shape that is generally complimentary with the generally concave shape of the cylindrical interior, the nozzle portion having a longitudinal flow passage having four inlet openings extending between an exterior of the nozzle portion adjacent the first end of the cylindrical interior of the body portion and a generally axial exit adjacent the second end of the cylindrical interior of the body portion, each of the four inlet openings being oriented at an angle relative to a radius of the nozzle portion;

an end cap at least partially enclosing the first end of the cylindrical interior, and having a generally circumferential groove facing the cylindrical interior; and a generally spherical member at least partially disposed within the circumferential groove and abutting at least a portion of the nozzle portion and configured for maintaining contact between the convex shape of the nozzle portion and the concave shape of the cylindrical interior.

18. The rotating nozzle of claim 17, wherein the generally conical body of the nozzle portion has an angle of about 10 degrees.

* * * * *